US009212541B2

(12) United States Patent
Richard et al.

(10) Patent No.: US 9,212,541 B2
(45) Date of Patent: Dec. 15, 2015

(54) SYSTEM AND APPARATUS FOR WELL SCREENING INCLUDING A FOAM LAYER

(75) Inventors: Bennett M. Richard, Kingwood, TX (US); Michael H. Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 905 days.

(21) Appl. No.: 12/567,166

(22) Filed: Sep. 25, 2009

(65) Prior Publication Data

US 2011/0073296 A1 Mar. 31, 2011

(51) Int. Cl.
*E21B 43/08* (2006.01)

(52) U.S. Cl.
CPC ..... *E21B 43/082* (2013.01); *Y10T 29/49885* (2015.01)

(58) Field of Classification Search
CPC .... E21B 43/082; E21B 43/086; E21B 43/103
USPC ..... 166/380, 278, 228
See application file for complete search history.

(56) References Cited

U.S. PATENT DOCUMENTS

| | | | | | |
|---|---|---|---|---|---|
| 2,837,032 | A | * | 6/1958 | Horsting, Sr. | 92/78 |
| 4,077,922 | A | * | 3/1978 | Farrissey et al. | 523/219 |
| 4,612,880 | A | * | 9/1986 | Brass et al. | 123/1 A |
| 4,771,079 | A | * | 9/1988 | Melber | 521/54 |
| 4,782,097 | A | * | 11/1988 | Jain et al. | 521/56 |
| 4,859,711 | A | * | 8/1989 | Jain et al. | 521/56 |
| 4,902,722 | A | * | 2/1990 | Melber | 521/54 |
| 4,977,958 | A | * | 12/1990 | Miller | 166/205 |
| 5,356,958 | A | * | 10/1994 | Matthews | 523/219 |
| 5,432,205 | A | * | 7/1995 | Arnold et al. | 521/54 |
| 5,837,739 | A | * | 11/1998 | Nowak et al. | 521/54 |
| 6,168,736 | B1 | * | 1/2001 | Harrison et al. | 264/112 |
| 6,213,209 | B1 | * | 4/2001 | Nguyen et al. | 166/276 |
| 6,766,862 | B2 | * | 7/2004 | Dusterhoft et al. | 166/381 |
| 6,935,432 | B2 | * | 8/2005 | Nguyen | 166/387 |
| 7,013,979 | B2 | * | 3/2006 | Richard | 166/369 |
| 7,048,048 | B2 | * | 5/2006 | Nguyen et al. | 166/227 |
| 7,243,732 | B2 | | 7/2007 | Richard | |
| 7,318,481 | B2 | | 1/2008 | Richard | |
| 7,392,852 | B2 | | 7/2008 | Richard | |

(Continued)

FOREIGN PATENT DOCUMENTS

| | | | |
|---|---|---|---|
| JP | 2002210333 | | 7/2002 |
| WO | WO2004099560 | A1 | 11/2004 |
| WO | WO2006113500 | A1 | 10/2006 |

OTHER PUBLICATIONS

SPE Distinguished Lecturer Series[online]; [retrieved on Sep. 25, 2009]; retrieved from the Internet at: http://www.spe.org/spe-site/spe/speievents/dl/Ott.pdf.

(Continued)

*Primary Examiner* — Jennifer H Gay
(74) *Attorney, Agent, or Firm* — Cantor Colburn LLP

(57) ABSTRACT

An apparatus for screening earth formation components and a method of making the apparatus, the apparatus including a base pipe configured to allow the passage of formation fluid therethrough, and a foam layer disposed radially outwardly of the base pipe and configured to allow the passage of formation fluid therethrough and minimize the passage of formation solids therethrough, the foam layer-including a plurality of hollow structures forming windows therebetween.

20 Claims, 4 Drawing Sheets

(56) References Cited

U.S. PATENT DOCUMENTS

| | | | | |
|---|---|---|---|---|
| 7,673,678 | B2 * | 3/2010 | MacDougall et al. | 166/228 |
| 7,703,520 | B2 * | 4/2010 | Dusterhoft | 166/278 |
| 7,708,073 | B2 * | 5/2010 | Richard et al. | 166/302 |
| 7,712,529 | B2 * | 5/2010 | Dusterhoft et al. | 166/278 |
| 7,743,835 | B2 * | 6/2010 | Willauer | 166/387 |
| 2002/0002208 | A1 * | 1/2002 | Martel et al. | 521/45.5 |
| 2003/0044301 | A1 * | 3/2003 | Lefebvre et al. | 419/2 |
| 2003/0131997 | A1 * | 7/2003 | Chatterji et al. | 166/278 |
| 2003/0220039 | A1 * | 11/2003 | Chen et al. | 442/327 |
| 2004/0055760 | A1 * | 3/2004 | Nguyen | 166/387 |
| 2004/0159435 | A1 * | 8/2004 | Plucheck et al. | 166/313 |
| 2004/0164499 | A1 * | 8/2004 | Murakami et al. | 277/628 |
| 2004/0171707 | A1 * | 9/2004 | Martel et al. | 521/54 |
| 2004/0217503 | A1 * | 11/2004 | Grinshpun et al. | 264/45.9 |
| 2004/0261994 | A1 * | 12/2004 | Nguyen et al. | 166/278 |
| 2005/0056425 | A1 * | 3/2005 | Grigsby et al. | 166/296 |
| 2005/0100470 | A1 * | 5/2005 | Lefebvre et al. | 419/2 |
| 2005/0205263 | A1 * | 9/2005 | Richard | 166/369 |
| 2005/0209354 | A1 * | 9/2005 | Martel et al. | 521/184 |
| 2006/0243363 | A1 * | 11/2006 | Hunter et al. | 149/109.2 |
| 2007/0155843 | A1 * | 7/2007 | Martel et al. | 521/50 |
| 2007/0207186 | A1 * | 9/2007 | Scanlon et al. | 424/424 |
| 2007/0244209 | A1 * | 10/2007 | Strandburg et al. | 521/142 |
| 2007/0246228 | A1 * | 10/2007 | Richard | 166/387 |
| 2007/0254057 | A1 * | 11/2007 | Grinshpun et al. | 425/325 |
| 2007/0273061 | A1 * | 11/2007 | Grinshpun et al. | 264/45.9 |
| 2008/0296020 | A1 * | 12/2008 | Willauer | 166/280.1 |
| 2008/0296023 | A1 * | 12/2008 | Willauer | 166/302 |
| 2008/0312064 | A1 * | 12/2008 | His et al. | 501/84 |
| 2009/0096121 | A1 * | 4/2009 | Azzi | 264/44 |
| 2009/0173496 | A1 | 7/2009 | Augustine | |
| 2009/0223678 | A1 * | 9/2009 | Richard et al. | 166/382 |
| 2010/0089565 | A1 * | 4/2010 | Duan et al. | 166/51 |
| 2011/0036578 | A1 * | 2/2011 | Coronado | 166/305.1 |
| 2011/0067872 | A1 * | 3/2011 | Agrawal | 166/302 |

OTHER PUBLICATIONS

International Search Report for International Application No. PCT/US2010/050226 mailed May 18, 2011.

Written Opinion of the International Searching Authority for International Application No. PCT/US2010/050226 mailed May 18, 2011.

* cited by examiner

SYSTEM AND APPARATUS FOR WELL SCREENING INCLUDING A FOAM LAYER

BACKGROUND

In the drilling and completion industry and for example in hydrocarbon exploration and recovery operations, efforts to improve production efficiency and increase output are ongoing. Some such efforts include utilizing and improving techniques for preventing undesirable solids from entering a tubing string. Such solids, often referred to collectively as "sand", can pose problems by reducing production efficiency, increasing production costs and wearing and/or damaging both downhole and surface components, for example.

Downhole screens are often employed for filtering formation fluid as it enters a tubing string to prevent entry of unwanted solids, such as sand packed or gravel packed screens. Many screening techniques fall short of efficiency and production expectations, especially in applications where boreholes are non-uniform and in formations that produce large amounts of sand during hydrocarbon production operations.

SUMMARY

Disclosed herein is an apparatus for screening earth formation components. The apparatus includes: a base pipe configured to allow the passage of formation fluid therethrough; and a foam layer disposed radially outwardly of the base pipe and configured to allow the passage of formation fluid therethrough and minimize the passage of formation solids therethrough, the foam layer including a plurality of hollow structures forming windows therebetween.

Also disclosed herein is a method of manufacturing an apparatus for screening earth formation components. The method includes: forming a base pipe configured to allow the passage of formation fluid therethrough; and disposing a foam layer radially outwardly of the base pipe, the foam layer configured to allow the passage of formation fluid therethrough and minimize the passage of formation solids therethrough, the foam layer including a plurality of hollow structures forming windows therebetween.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
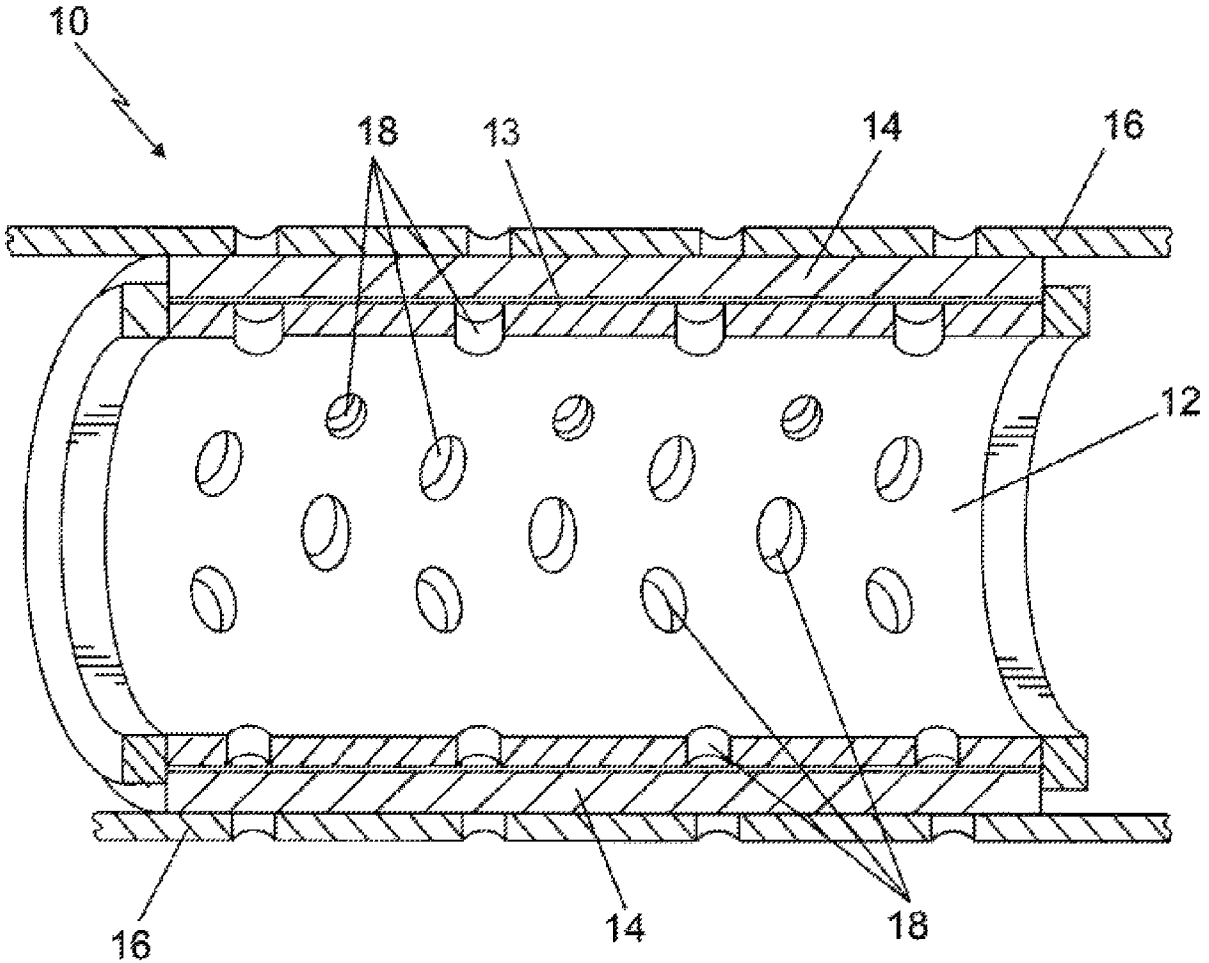
FIG. 1 is a cross-sectional view of an exemplary embodiment of a downhole screen.

Referring to FIG. 1, an exemplary embodiment of a borehole screen joint 10 is shown. As described herein, a "screen" or "screen joint" refers to any component and/or system configured to be deployed downhole and filter unwanted particulates and other solids from formation fluids as the formation fluids enter a production string. The screen joint 10 includes a base pipe 12, a foam layer 14 positioned radially outwardly of the base pipe 12, and a shroud 16 positioned radially outwardly of the foam layer 14. The foam layer 14 comprises foam having a plurality of hollow structures that form interstices or windows therebetween.

The base pipe 12 is a tubular member made of a material such as a steel alloy. In one embodiment, the base pipe 12 is a portion of a downhole string such as a hydrocarbon production string or a drill string. As described herein, "string", "production string" or "drill string" refers to any structure or carrier suitable for lowering a tool or other component through a borehole or connecting a drill bit to the surface, and is not limited to the structure and configuration described herein. In one embodiment, the base pipe 12 is a pipe segment, and includes suitable connection mechanisms, such as threaded configurations, to connect the screen joint 10 to adjacent components.

In one embodiment, the base pipe 12 is a solid tubular component and includes a number of holes or apertures 18 to allow formation fluid to pass therethrough. As described herein, "formation fluid" refers to hydrocarbons, water and any other substances in fluid form that may be produced from an earth formation. In one embodiment, the base pipe 12 is a rigid structure that maintains its shape and diameter when deployed downhole.

The shroud 16, in one embodiment, is a vector shroud. The shroud 16 may include a plurality of perforations or other openings to allow and/or direct the passage of formation fluid therethrough. The shroud 16 is made of a durable material, such as steel, that resists corrosion and wear in the downhole environment and helps to protect the foam layer 14 and the base pipe 12. In one embodiment, the shroud 16 is made from a suitable type of sheet metal. In one embodiment, the shroud 16 is configured to resist erosion under downhole turbulent flow conditions.

The foam layer 14 is disposed between the base pipe 12 and the shroud 16, and acts as a filter to allow formation fluids to pass through and limit, minimize or prevent the passage of unwanted solid matter such as sand. The foam layer 14, in one embodiment, has a generally cylindrical shape that generally conforms to the outer shape of the base pipe 12. However, the foam layer may form any shape desired, for example, to facilitate deployment of the screen joint 10 and/or to enhance filtering qualities.

In one embodiment, the screen joint 10 is manufactured or assembled prior to deploying the screen joint 10 in a borehole. The screen joint 10 may be deployed and commence filtering formation fluid without the need for significant downhole modification, such as expansion of the screen joint 10.

In one embodiment, the foam layer 14 comprises foam that is thermosetting or thermoplastic. The foam may be a compressible foam. In one embodiment, the foam is an elastic shape memory foam such as an open cell syntactic foam. Shape memory foams can be deformed or re-shaped by increasing the temperature of the foam beyond a threshold temperature. When the foam is above the threshold temperature, it can be deformed into a new shape and then the temperature can be lowered below the threshold temperature to retain the new shape. The foam reverts back to its original shape when its temperature is again increased beyond the threshold temperature. Shape memory and/or thermosetting properties may be useful, for example, in facilitating manufacture, assembly and/or deployment of the screen joint 10.

The foam layer 14 may be made of any suitable material. For example, in one embodiment, the foam layer is made of a porous, thermosetting shape memory polymer. In another example, the foam layer is a polyurethane (PU) shape memory foam. The PU foam may be an advanced polyurethane foam with engineered pore spaces and flexibility to resist cracking and or sand grain shifting.

Figure 2:
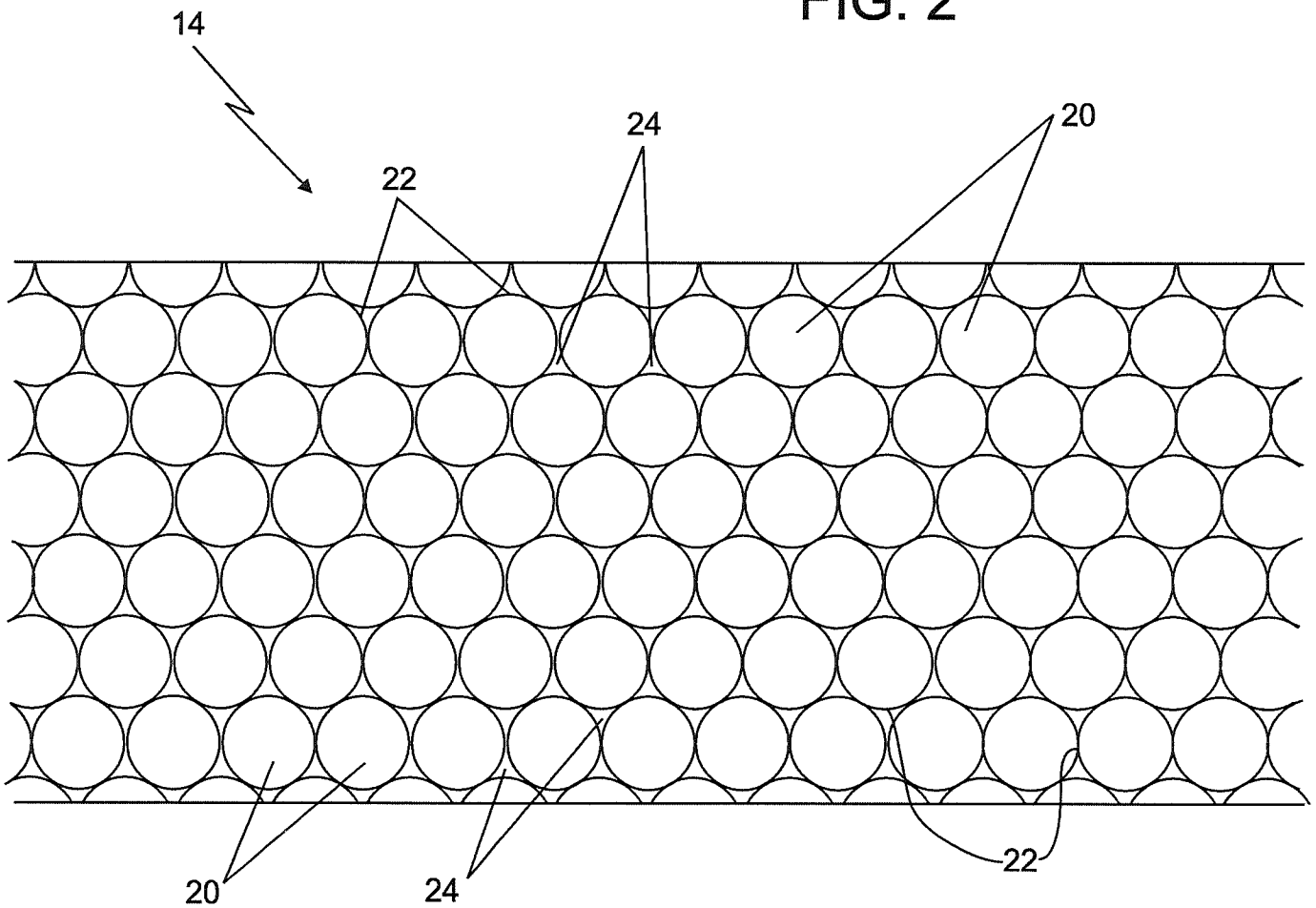
FIG. 2 is a cross-sectional view of a foam layer of the screen of FIG. 1.

Referring to FIG. 2, the foam of the foam layer 14 includes a plurality of hollow structures, such as hollow spheres and/or microballoons 20. The hollow structures, in one embodiment, are hollow spheres 20 or hollow sphere-like shapes having walls 22 that are in contact with one another. The hollow spheres 20 form a plurality of interstices or windows 24 between the hollow spheres 20. These windows 24 allow the passage of formation fluid therethrough but are small enough in size to form volumes that are smaller than the volume of unwanted solid particles such as sand grains or rock fragments. When solid particles penetrate the foam layer 14, they can become trapped in the matrix formed by the foam. In this instance, such particles may at least partially fill the volume of the spheres 20. The windows 24 are not filled by the solid particles and thus permeability is maintained. The spheres 20 can therefore be packed without significantly affecting the permeability of the foam layer 14, as the permeability is significantly dependent on the windows 24 formed between the sphere walls 22. For example, a PU foam is configured so that the windows 24 of the foam only begin collapsing once the foam is at greater than about sixty percent compaction, and thus the foam can be compacted up to approximately sixty percent without a significant decrease in overall permeability.

Figure 3:
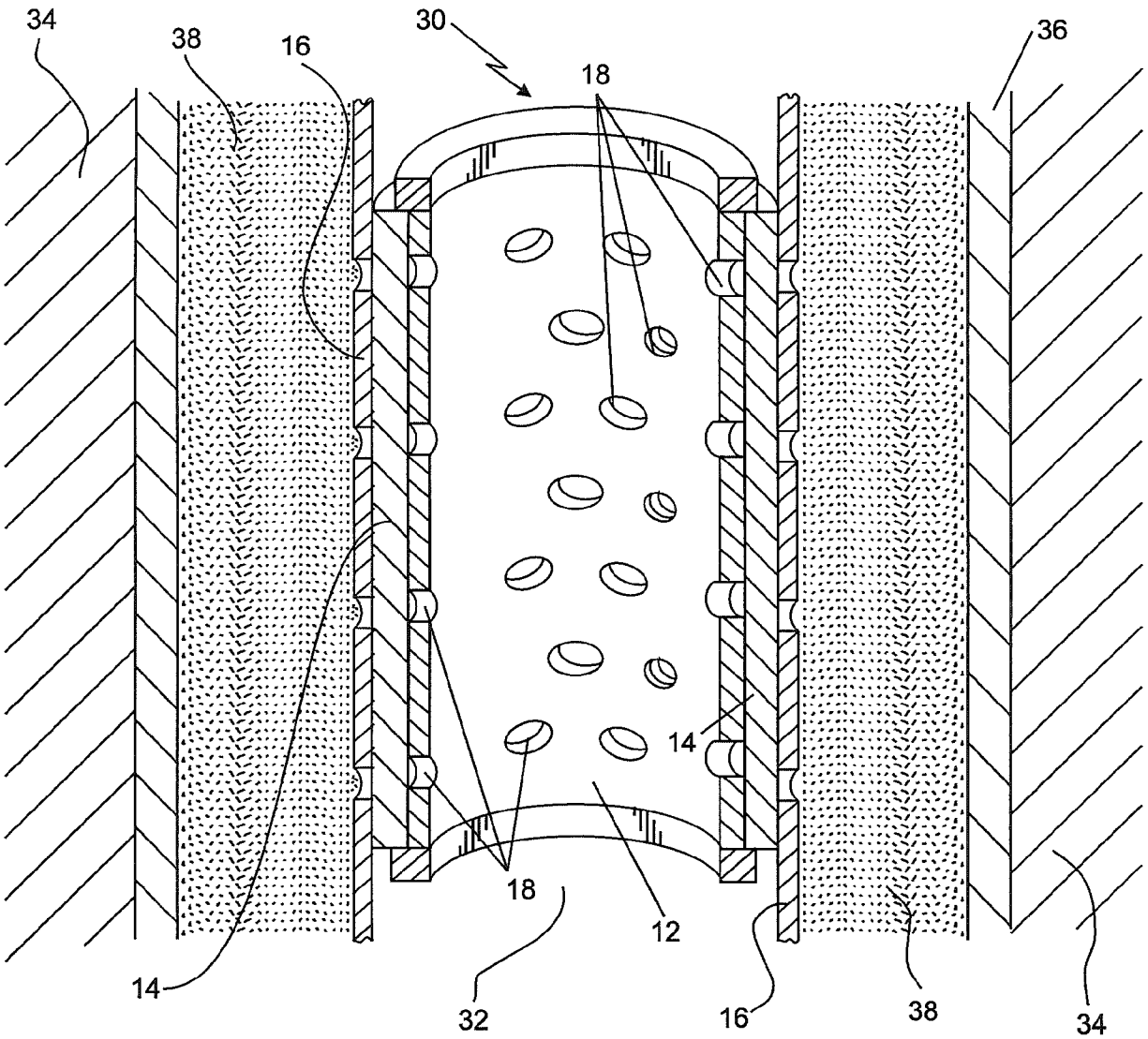
FIG. 3 is a cross-sectional view of a downhole filter assembly.

Referring to FIG. 3, an exemplary embodiment of a portion of a downhole filter assembly 30 is shown. The downhole filter assembly 30 includes the screen joint 10 and is configured as a screen assembly that incorporates a granular material, such as sand or gravel. In this embodiment, the downhole filter assembly 30 is referred to as a "sand pack screen".

In one embodiment, the downhole filter assembly 30 is configured to be disposed within a borehole 32 in an earth formation 34. As shown in FIG. 3, well tubing or casing 36 is disposed in the borehole 32 proximate to the borehole wall, and granular material 38 is disposed in at least a portion of the annular space formed between the screen joint 10 and the well casing 36. In another embodiment, the granular material 38 is disposed between the screen joint 10 and the borehole wall.

In one embodiment, the porosity of the granular material 38 is less than the porosity of the foam layer 14 and greater than the porosity of the formation 34. This configuration of successively increasing porosities aids in reducing or preventing the formation fluid from plugging the downhole filter assembly 30.

Figure 4:
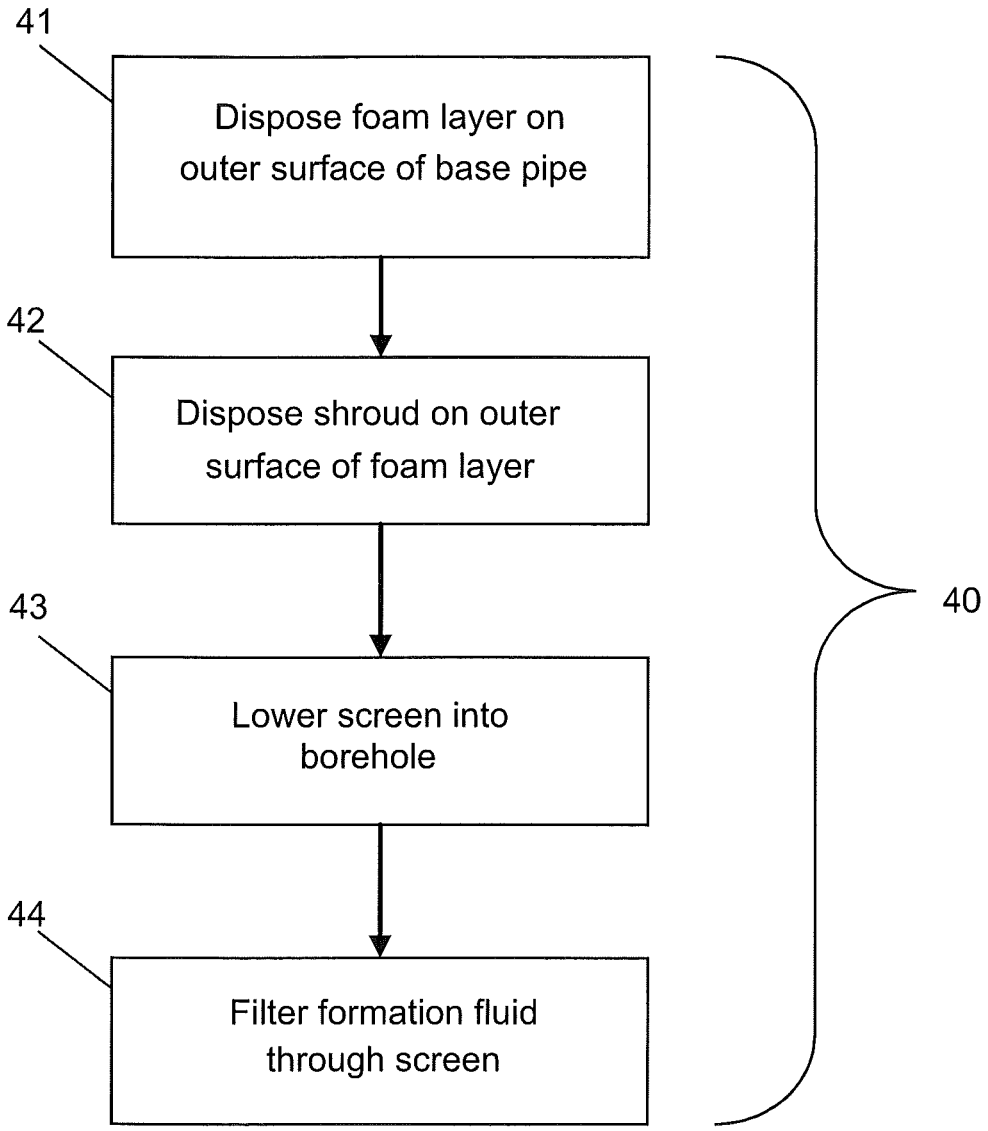
FIG. 4 is a flow diagram depicting a method of manufacturing and/or deploying a screen in a borehole.

FIG. 4 illustrates a method 40 of manufacturing and/or deploying a screening apparatus in a borehole in an earth formation. The method 40 includes one or more stages 41-44. The method 40 is described in conjunction with the screen joint 10 described herein, but may be used with any suitable screening mechanism that is deployable downhole. In one embodiment, the method 40 includes the execution of all of stages 41-44 in the order described. However, certain stages may be omitted, stages may be added, or the order of the stages changed.

In the first stage 41, the foam layer 14 is disposed on and/or around an outer surface of the base pipe 12 or a drainage layer such as an intermediate drainage layer 13 disposed radially outwardly of the base pipe 12. In one embodiment, the intermediate drainage layer 13 is disposed radially between the base pipe 12 and the foam layer 14. This can be accomplished by any desired method that results in a foam layer of a desired thickness and shape on the outer surface of the base pipe 12 or an intermediate drainage layer 13. For example, the foam layer 14 is sprayed or molded on the surface. In another example, a foam blanket having a desired thickness is wrapped around the base pipe 12 or an intermediate drainage layer 13.

In one embodiment, the shape memory and/or thermosetting characteristics of the foam are utilized to facilitate manufacture and/or deployment. For example, a thermosetting foam layer 14 is heated above a threshold temperature and thereafter formed onto the base pipe 12 or an intermediate drainage layer. After the foam layer 14 cools, it retains its shape around the base pipe 12 or an intermediate drainage layer 13.

In another example, a shape memory foam layer 14 is applied to the base pipe 12 or an intermediate drainage layer 13, and formed to produce a desired shape, and then heated to a temperature greater than a threshold temperature. The memory foam layer 14 is compressed to reduce its thickness or otherwise shaped to facilitate deployment of the screen joint 10 downhole. The memory foam layer 14 is then cooled to a temperature below the threshold temperature to maintain the compressed shape prior to the outer shroud being installed. After the screen joint 10 is deployed, the elevated temperature downhole causes the memory foam layer 14 to revert to its original desired shape. Alternatively, if the downhole temperature is lower than the threshold temperature, a separate heat source can be deployed downhole to heat the memory foam layer 14. This shape memory effect will allow deployment of a closed cell foam eliminating the possibility of screen plugging during run in.

In one embodiment, the foam layer 14 is a shape memory foam. However, the shape memory characteristics are not utilized, and the screen joint 10 can be deployed in its original shape.

In the second stage 42, the shroud 16 is disposed on and/or around the outer surface of the foam layer 14. This may be accomplished by any suitable method, such as sliding the shroud 16 over the foam layer 14, or fastening multiple portions of the shroud 16 around the foam layer 14. In one embodiment, the shroud 16 is slid or otherwise disposed on the foam layer 14 when the foam layer 14 is in a compressed state. When the screen joint 10 is deployed downhole, the foam layer 14 will expand to its original shape.

In the third stage 43, the screen joint 10 is lowered into a borehole or otherwise disposed downhole. The screen joint 10 may be lowered as part of a production string or lowered by any suitable method or device, such as a wireline.

In the fourth stage 44, formation fluid is filtered through the screen joint 10 as the formation fluid advances into the production string and flows to the surface.

The systems and methods described herein provide various advantages over existing processing methods and devices, in that they provide better filtration efficiency, improved erosion characteristics due to foam elasticity, deployment benefits such as reducing sand shifting or cracking which is exhibited by conventional prepack screens, and more flexibility than conventional sand packed or gravel packed screens. For example, the foam layer described herein exhibits superior erosion resistance as compared to conventional metal screens.

For example, sand screens generally have about 30% porosity, whereas the foams described herein have up to about 70% porosity, the inverse of a conventional gravel pack or sand pack. Contrary to concerns that foams such as those described herein would collapse and plug as formation sand penetrates the foams, the foams described herein, such as those being made of hollow spheres or other structures, maintain significant permeability even after sand penetration. For example, sand penetration may cause the spheres to be packed, but the windows between spheres remain open, thus preserving permeability.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention.

The invention claimed is:

1. An apparatus for screening earth formation components, comprising:

a base pipe configured to direct the passage of formation fluid; and a foam layer disposed radially outwardly of the base pipe and configured to allow the passage of formation fluid therethrough and minimize the passage of formation solids therethrough, the foam layer including a plurality of closed hollow structures arranged to form interstices located between walls of adjacent ones of the hollow structures.

2. The apparatus of claim 1, wherein the foam layer is made of a thermosetting foam or a thermoplastic foam.

3. The apparatus of claim 1, wherein the foam layer is made of an elastic shape memory foam.

4. The apparatus of claim 1, wherein the foam layer is a syntactic foam.

5. The apparatus of claim 1, wherein the foam layer is made of a polyurethane shape memory foam.

6. The apparatus of claim 1, further comprising a drainage layer positioned radially between the base pipe and the foam layer.

7. The apparatus of claim 1, wherein the plurality of hollow structures are at least one of a plurality of hollow spheres and a plurality of microballoons.

8. The apparatus of claim 7, wherein each of the plurality of hollow structures are in contact with one another, and form the interstices therebetween.

9. The apparatus of claim 1, wherein the foam layer is made of a compressible foam.

10. The apparatus of claim 1, further comprising a granular material disposed between the foam layer and a borehole wall.

11. The apparatus of claim 1, further comprising a protective shroud disposed about the foam layer.

12. A method of manufacturing an apparatus for screening earth formation components, comprising:

forming a base pipe configured to direct the passage of formation fluid; and disposing a foam layer radially outwardly of the base pipe, the foam layer configured to allow the passage of formation fluid therethrough and minimize the passage of formation solids therethrough, the foam layer including a plurality of closed hollow structures arranged to form interstices located between walls of adjacent ones of the hollow structures.

13. The method of claim 12, further comprising disposing a protective shroud about the foam layer.

14. The method of claim 12, further comprising deploying the apparatus in a borehole.

15. The method of claim 12, wherein the plurality of hollow structures are at least one of a plurality of hollow spheres and a plurality of microballoons.

16. The method of claim 15, wherein each of the plurality of hollow structures is in contact with one another, and form the interstices therebetween.

17. The method of claim 12, wherein the foam layer is made of a shape memory foam.

18. The method of claim 17, wherein disposing the foam layer includes forming the foam layer to a desired shape, heating the foam layer to a temperature above a threshold temperature, forming the foam layer into a deployment shape configured to facilitate deployment of the apparatus, and cooling the foam layer to a temperature below the threshold temperature to maintain the deployment shape.

19. The method of claim 18, further comprising disposing the apparatus in a borehole and heating the foam layer to cause the foam layer to revert to the desired shape.

20. The method of claim 12, wherein disposing the foam layer includes heating the foam layer to a temperature above a threshold temperature, forming the foam layer to a desired shape, and cooling the foam layer to maintain the desired shape.

* * * * *